US007343836B1

(12) United States Patent
Ward

(10) Patent No.: US 7,343,836 B1
(45) Date of Patent: Mar. 18, 2008

(54) BENDER WRENCH

(75) Inventor: Jess G. Ward, Twin Falls, ID (US)

(73) Assignee: Jess Ward, Twin Falls, ID (US)

( * ) Notice: Subject to any disclaimer, the term of this patent is extended or adjusted under 35 U.S.C. 154(b) by 0 days.

(21) Appl. No.: 11/069,352

(22) Filed: Mar. 1, 2005

(51) Int. Cl.
*B25B 23/16* (2006.01)
*B25G 1/00* (2006.01)

(52) U.S. Cl. ..... 81/177.7; 81/177.6

(58) Field of Classification Search ..... 81/119, 81/121.1, 177.6–177.8, 177.9; D8/21–23, D8/26–28
See application file for complete search history.

(56) References Cited

U.S. PATENT DOCUMENTS 1,060,138 A * 4/1913 Schoenborn ..... 81/177.9
1,316,398 A * 9/1919 Steininger ..... 81/119
1,363,274 A 12/1920 Saffold
1,805,298 A * 5/1931 Schweigert ..... 81/177.8
1,811,137 A * 6/1931 Kress ..... 81/124.3
2,426,763 A 9/1947 Curtis
2,680,985 A 6/1954 Fish
2,708,855 A 5/1955 Fish
2,886,998 A 5/1959 Scott
3,383,962 A 5/1968 Harris
3,779,107 A 12/1973 Avery
3,839,929 A 10/1974 Richard
4,084,456 A * 4/1978 Pasbrig ..... 81/177.8
4,327,611 A * 5/1982 Catanese et al. ..... 81/177.9
4,488,461 A 12/1984 Hurtig
4,688,454 A 8/1987 Scull
4,774,862 A 10/1988 Scull
D325,864 S * 5/1992 Diego ..... D8/28
5,218,891 A 6/1993 Olson et al.
5,230,263 A 7/1993 Kwaka
5,279,189 A 1/1994 Marino
D351,770 S 10/1994 Stone
D413,775 S 9/1999 Hulsey et al.
6,138,533 A 10/2000 Turtle
6,289,772 B1 * 9/2001 Ying-Wen ..... 81/119
6,354,175 B1 * 3/2002 Dobson et al. ..... 81/119
6,382,058 B1 * 5/2002 Owoc ..... 81/177.9
6,412,374 B1 * 7/2002 Hsieh ..... 381/177.7
6,523,440 B2 * 2/2003 Friedman et al. ..... 81/125.1
D488,967 S * 4/2004 Hsien ..... D8/25
D506,373 S * 6/2005 Hsien ..... D8/28
2002/0139226 A1 * 10/2002 Hansen ..... 81/177.8
2003/0188607 A1 * 10/2003 Hsien ..... 81/177.7

OTHER PUBLICATIONS

INTERNET, "www.copperhandtools.com/brands/crescent/index.htm,Crescent Pivot Head Ratcheting Combination Wrench,".

* cited by examiner

*Primary Examiner*—David B Thomas
(74) *Attorney, Agent, or Firm*—Gardere Wynne Sewell LLP

(57) ABSTRACT

A bender wrench for removing fasteners from hard to reach places. The bender wrench includes a wrench having a pair of first ends coupled to a plurality of head members that are positionable with respect to the handle. Each of the head members is designed to remove or tighten a fastener without slipping.

1 Claim, 3 Drawing Sheets

BENDER WRENCH

RELATED APPLICATION

This application is a substitute for U.S. patent application Ser. No. 10/122,924, filed Apr. 12, 2002, now abandoned.

BACKGROUND OF THE INVENTION

1. Field of the Invention

The present invention relates to a bender wrench and more particularly pertains to a new bender wrench for removing fasteners from hard to reach places.

2. Description of the Prior Art

The use of a bender wrench is known in the prior art. More specifically, a bender wrench heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,084,456; U.S. Pat. No. 3,383,962; U.S. Pat. No. 1,363,274; U.S. Pat. No. 4,488,461; U.S. Pat. No. 3,379,107; and U.S. Pat. No. Des. 351,770.

While these devices fulfill their respective, particular objectives and requirements, the aforementioned patents do not disclose a new bender wrench. The inventive device includes a wrench having a pair of first ends coupled to a plurality of head members that are positionable with respect to the handle.

In these respects, the bender wrench according to the present invention substantially departs from the conventional concepts and designs of the prior art, and in so doing provides an apparatus primarily developed for the purpose of removing fasteners from hard to reach places.

SUMMARY OF THE INVENTION

In view of the foregoing disadvantages inherent in the known types of a bender wrench now present in the prior art, the present invention provides a new bender wrench construction wherein the same can be utilized for removing fasteners from hard to reach places.

The general purpose of the present invention, which will be described subsequently in greater detail, is to provide a new bender wrench apparatus and method which has many of the advantages of the a bender wrench mentioned heretofore and many novel features that result in a new bender wrench which is not anticipated, rendered obvious, suggested, or even implied by any of the prior art a bender wrench, either alone or in any combination thereof.

To attain this, the present invention generally comprises a wrench having a pair of first ends coupled to a plurality of head members that are positionable with respect to the handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bender wrench apparatus and method that has many of the advantages of the a bender wrench mentioned heretofore and many novel features that result in a new bender wrench that is not anticipated, rendered obvious, suggested, or even implied by any of the prior art a bender wrench, either alone or in any combination thereof.

It is another object of the present invention to provide a new bender wrench that may be easily and efficiently manufactured and marketed.

It is a further object of the present invention to provide a new bender wrench which is of a durable and reliable construction.

An even further object of the present invention is to provide a new bender wrench which is susceptible of a low cost of manufacture with regard to both materials and labor, and which accordingly is then susceptible of low prices of sale to the consuming public, thereby making such bender wrench economically available to the buying public.

Still yet another object of the present invention is to provide a new bender wrench which provides in the apparatuses and methods of the prior art some of the advantages thereof, while simultaneously overcoming some of the disadvantages normally associated therewith.

Still another object of the present invention is to provide a new bender wrench for removing fasteners from hard to reach places.

Yet another object of the present invention is to provide a new bender wrench which includes a wrench having a pair of first ends coupled to a plurality of head members which are positionable with respect to the handle.

Still yet another object of the present invention is to provide a new bender wrench that is easy to use.

Even still another object of the present invention is to provide a new bender wrench that is easy to understand how to repair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
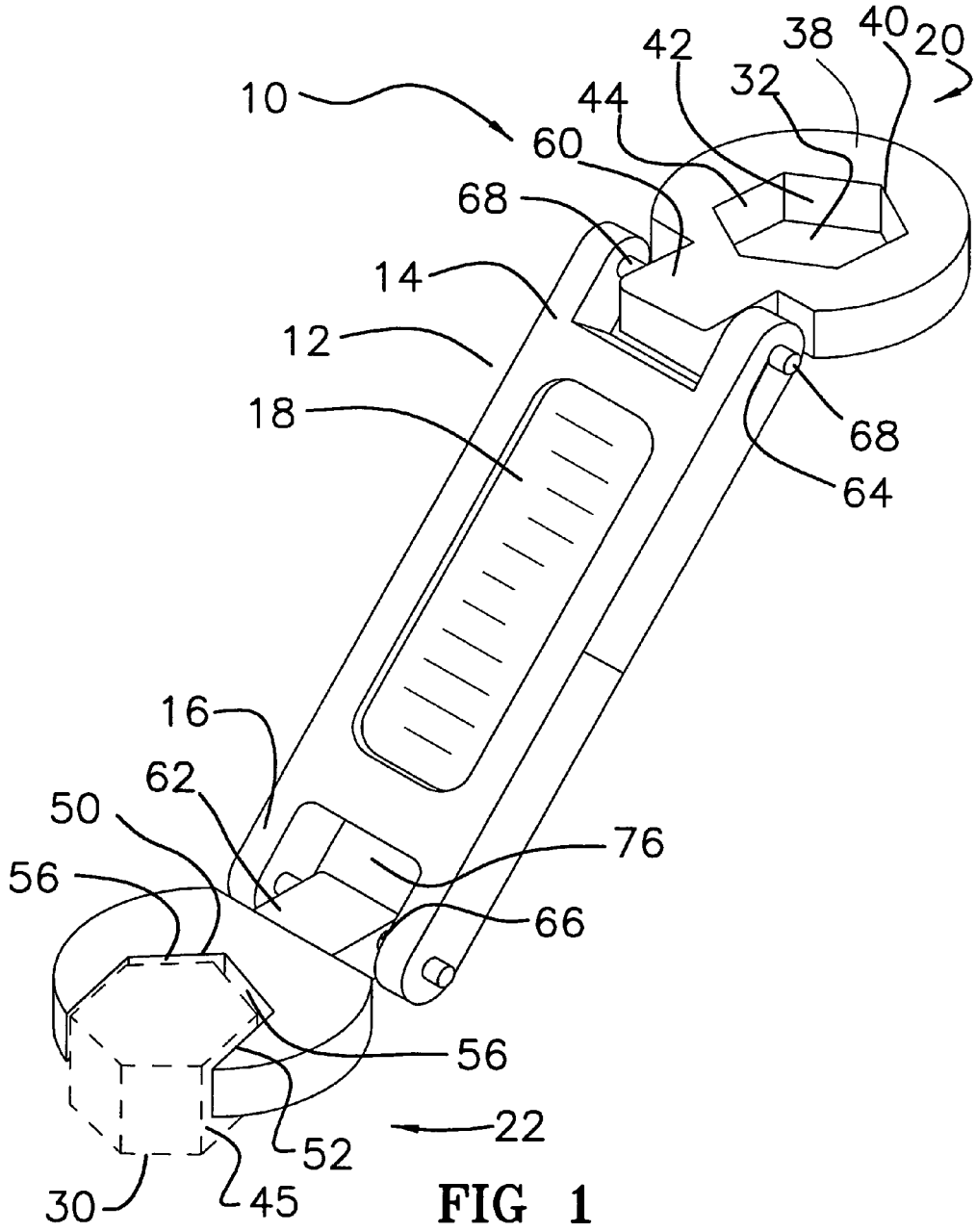
FIG. 1 is a perspective view of a new bender wrench according to the present invention.
Figure 2:
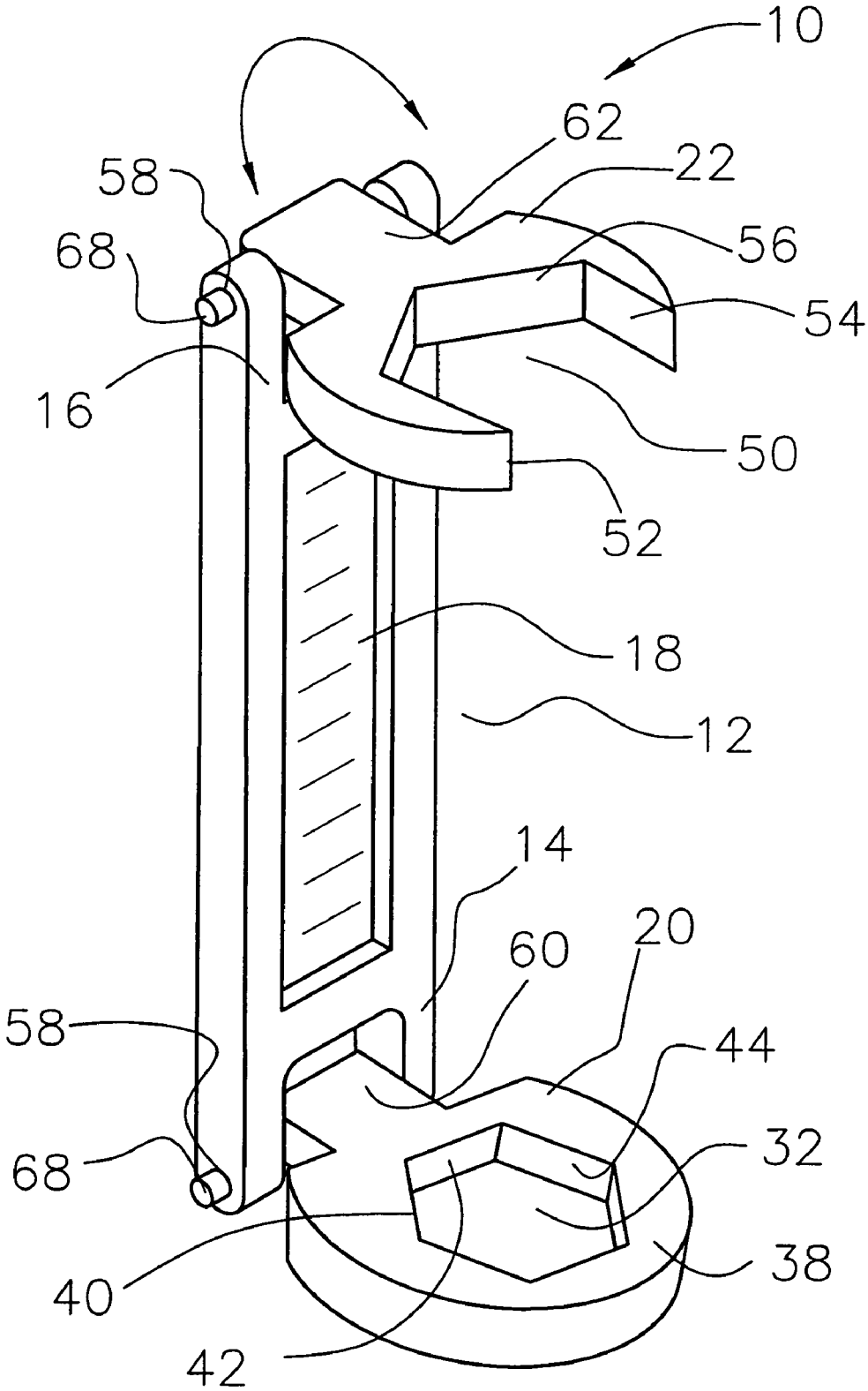
FIG. 2 is a further perspective view of the present invention with ends in pivotal position.
Figure 3:
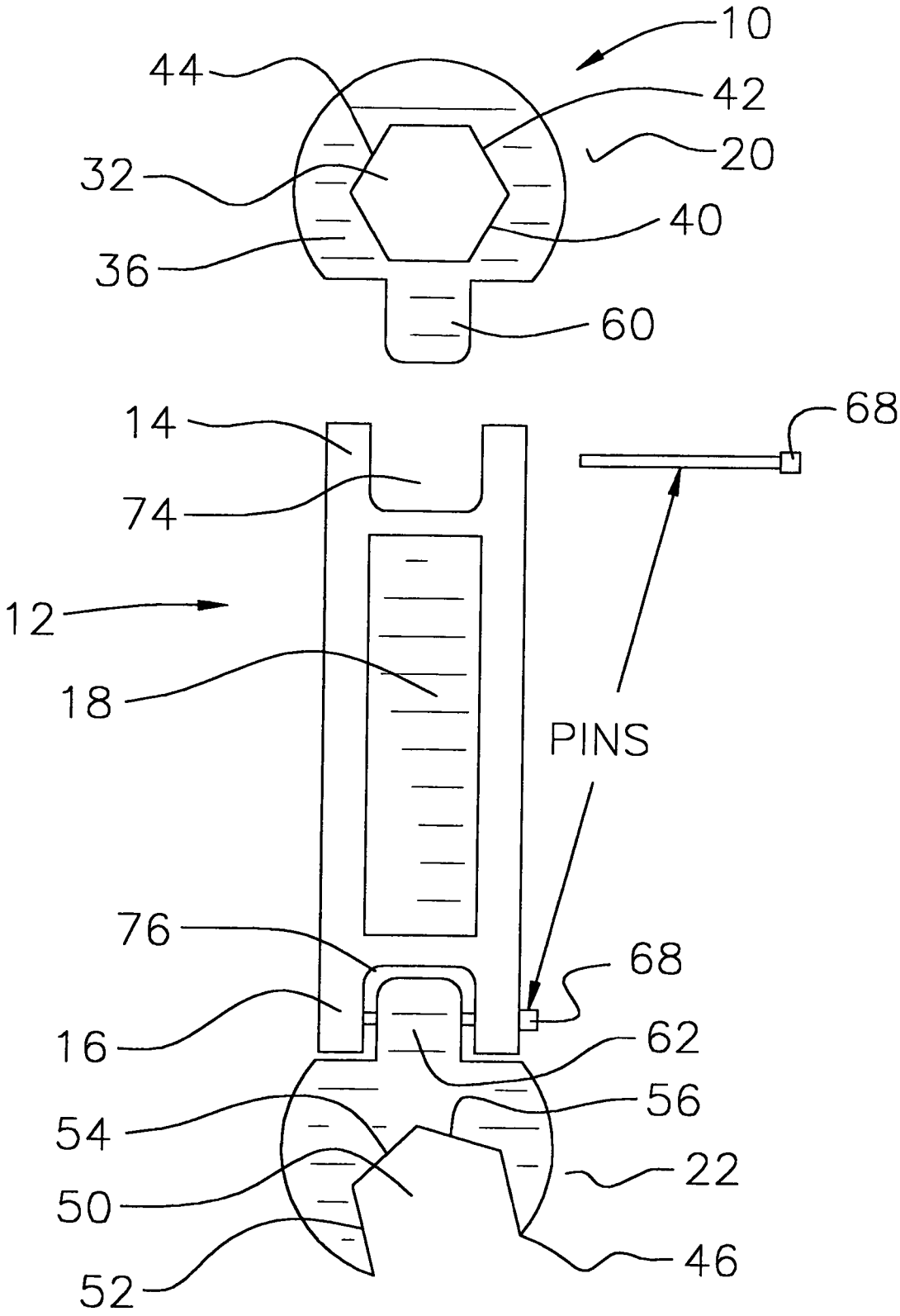
FIG. 3 is an anterior view of the present invention.

With reference now to the drawings, and in particular to FIGS. 1 through 3 thereof, a new bender wrench embodying the principles and concepts of the present invention and generally designated by the reference numeral 10 will be described.

As best illustrated in FIGS. 1 through 3, the bender wrench 10 of the invention is highly suitable for removing fasteners, especially in hard to reach areas. The wrench 10 comprises a body member 12 includes a pair of first ends 14, 16 and a handle portion 18. The handle portion 18 is designed for gripping by a hand of a user. The invention also includes a plurality of head members 20, 22. Each head member of the plurality of head members 20, 22 is pivotally coupled to one of the ends 14, 16 of the body member 12. Each of the head members 20, 22 is designed for selectively coupling to a fastener 30.

In a significant feature of the invention, each of the head members 20, 22 is positionable at an angle with respect to the body member 12. Each of the head members 20, 22 can be coupled to the fastener 30 to permit rotation and removal of the fastener 30 when the fastener 30 is located in a hard to reach location. At least one of the head members 20, 22 includes an aperture 32 extending between a bottom face 36 and a top face 38 of an associated one of the head members 20. The aperture 32 is designed for receiving the fastener 30. Each of the head members 20, 22 is designed for rotating the fastener 30 when the body member 12 is rotated around the fastener 30. The aperture 32 of the associated one of the head members 20 includes a perimeter wall 40. The perimeter wall 40 includes a plurality of faces 42, 44 that define the aperture, each of the faces 42, 44 of the perimeter wall 40 is designed for abutting one of a plurality of surfaces of the fastener 30 such that the faces engage the faces of a fastener for preventing the head member 20 from slipping around the fastener 30.

At least one of the head members 22 includes a cut out 50 extending inwardly from a front face 46 of the head member 22. The cut out 50 is designed for receiving the fastener 30. Each of the head members 20, 22 is designed for rotating the fastener 30 when the body member 12 is rotated around the fastener 30. The cut out 50 of the associated one of the head members 22 includes a peripheral wall 52. The peripheral wall 52 includes a plurality of abutment walls 54, 56 defining the cut out 50. Each of the abutment walls 54, 56 of the perimeter wall 52 is designed for abutting one of a plurality of surfaces of the fastener 30 such that the abutment walls 54, 56 are for preventing the associated one of the head members 22 from slipping around the fastener 30.

Each of the head members 20, 22 includes a shank 60, 62. The shank 60, 62 of each of the head members 20, 22 includes a bore 64, 66 that extends through the shank 60, 62. Each of the ends 14, 16 of the body member 12 includes a channel 74, 76. The channel 74 of one of the ends 14 of the body member 12 receives the shank 60 of one of the head members 20 such that a pair of pin apertures 58 of the body member 12 are aligned with the bore 64 of the shank 60 of an associated one of the head members 20.

A pin 68 is removably insertable through each one of the pin apertures 58 of the body member 12 and the bore 64 of the shank 60 of the associated one of the head members 20. The shank 60 of the associated one of the head members 20 is inserted into the channel 74 of one of the ends 14 of the body member 12 such that the pin 68 permits the head member 20 to pivot with respect to the body member 12. Each of the pins 68 has a first end that is capable of moving through the pin apertures 58 of the body member 12 and through the bore 64 of the shank 60 of the associated one of the head members 20. Each of the pins 68 has a second end that is enlarged in size such that the second end is incapable of moving through the pin apertures 58 of the body member 12 and through the bore 64 of the shank 60 of the associated one of the head members 20.

In use, the hand of the user grips the handle of the bender wrench and selectively places the aperture over the fastener turning the wrench clockwise to tighten or counter-clockwise to loosen the fastener.

With respect to the above description then, it is to be realized that the optimum dimensional relationships for the parts of the invention, to include variations in size, materials, shape, form, function and manner of operation, assembly and use, are deemed readily apparent and obvious to one skilled in the art in view of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wrench being for removing fasteners from hard to reach areas, the wrench comprising:

a body member having a pair of first ends and a handle portion, said handle portion having a central recessed rectangular portion forming a peripheral ridge extending around said handle portion whereby said handle portion is adapted for being securely gripped by a hand of a user, said body member having a pair of opposite side edges extending an entire length of said body member, each of said side edges being linear between said first end such that said body member has a uniform width between said side edges from one end of said pair of first ends to another end of said pair of first ends;

a plurality of head members, each head member being pivotally coupled to an associated one of said ends of said body member, each of said head members being adapted for selectively coupling to a fastener, each of said head members being positionable at an angle with respect to said body member such that each of said head members can be coupled to the fastener for facilitating removal of the fastener when the fastener is located in a hard to reach location;

at least one of said head members having an aperture extending between a bottom face and a top face of an associated one of said head members, said aperture being adapted for receiving the fastener, each of said head members being adapted for rotating the fastener when said body member is rotated around the fastener;

said aperture of the associated one of said head members having a perimeter wall, said perimeter wall having a plurality of faces defining said aperture, each of said faces of said perimeter wall being adapted for abutting one of a plurality of surfaces of the fastener such that said faces are for preventing said head member from slipping around the fastener;

at least one of said head members having a cut out inwardly extending from a front face of an associated one of said head members, said cut out being adapted for receiving the fastener, each of said head members being adapted for rotating the fastener when said body member is rotated around the fastener;

said cut out of the associated one of said head members having a peripheral wall, said peripheral wall having a plurality of abutment walls defining said cut out, each of said abutment walls of said perimeter wall being adapted for abutting one of a plurality of surfaces of the fastener such that said abutment walls are for preventing the associated one of said head members from slipping around the fastener;

each of said head members having a shank, said shank of each of said head members having a bore extending through said shank, each of said ends of said body member having a channel extending inwardly from the respective said end of said body member, said channel having a substantially uniform transverse width, said channel of one of said ends of said body member receiving said shank of one of said head members such that a pair of pin apertures of said body member are aligned with said bore of said shank of an associated one of said head members, a longitudinal axis extending through said pair of pin apertures being transverse to a longitudinal axis of said handle portion; and a pin extending through one of said pin apertures of said body member and said bore of said shank of said head members when said shank of the associated one of said head members is inserted into said channel of one of said ends of said body member such that said pin permits the associated said head member to pivot with respect to said body member, each said pin having a first end capable of moving through said pin apertures of said body member, each said pin member having a second end with an enlarged portion that is incapable of moving through said pin apertures of said body member.

* * * * *